United States Patent [19]

Fehrer

[11] Patent Number: 4,534,086

[45] Date of Patent: Aug. 13, 1985

[54] APPARATUS FOR MAKING FIBROUS WEBS

[76] Inventor: Ernst Fehrer, Auf der Gugl 28, A-4020 Linz, Austria

[21] Appl. No.: 604,302

[22] Filed: Apr. 26, 1984

[30] Foreign Application Priority Data

| | | | |
|---|---|---|---|
| May 5, 1983 | [AT] | Austria | 1649/83 |
| Nov. 8, 1983 | [AT] | Austria | 3919/83 |
| Jan. 16, 1984 | [AT] | Austria | 107/84 |
| Jan. 26, 1984 | [AT] | Austria | 253/84 |

[51] Int. Cl.[3] ..... D01G 15/26

[52] U.S. Cl. ..... 19/99; 19/145.7; 19/302

[58] Field of Search ..... 19/98, 99, 105, 296, 19/302, 301, 145.7

[56] References Cited

U.S. PATENT DOCUMENTS

| | | | |
|---|---|---|---|
| 40,049 | 9/1863 | Kitson | 19/302 |
| 765,916 | 7/1904 | Carter | 19/302 |
| 3,983,273 | 9/1976 | Elliott | 19/99 X |
| 4,126,914 | 11/1978 | Winch et al. | 19/99 |

FOREIGN PATENT DOCUMENTS

| | | | |
|---|---|---|---|
| 0325996 | 11/1975 | Austria . | |
| 0006970 | 4/1982 | European Pat. Off. . | |
| 0133934 | 9/1902 | Fed. Rep. of Germany . | |
| 4913951 | 10/1969 | Japan | 19/301 |
| 0019464 | of 1890 | United Kingdom | 19/99 |
| 1120222 | 7/1968 | United Kingdom . | |

*Primary Examiner*—Louis K. Rimrodt
*Attorney, Agent, or Firm*—Kurt Kelman

[57] ABSTRACT

A fibrous feed web is delivered by a feeder to tooth-carrying carding drums, which rotate at a surface velocity which causes the fibers to flow off under centrifugal force to fly onto a continuously moving, air-permeable collecting surface, which is subjected to suction. In order to make a uniform fibrous web with simple structural means even at a high throughput, the carding drums are closely spaced apart in the direction of movement of the collecting surface and each carding drum which succeeds another carding drum in the direction of movement of the collecting surface constitutes a working roller for such preceding carding drum.

12 Claims, 1 Drawing Figure

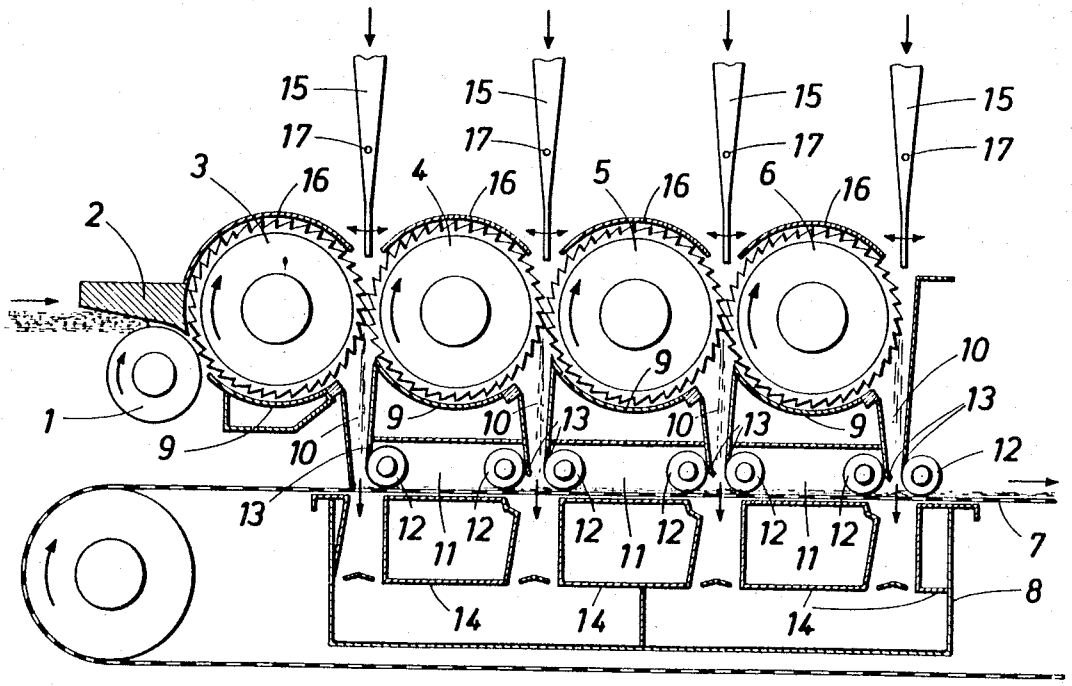
1
2
3
4
5
6
7
8
9
10
11
12
13
14
15
16
17

APPARATUS FOR MAKING FIBROUS WEBS

BACKGROUND OF THE INVENTION

This invention relates to apparatus for making fibrous webs, comprising a feeder for feeding a fibrous feed web tooth-carrying carding drums, which rotate in the same sense at such a surface velocity that carded fibers fly off the drum under centrifugal force, and a continuously moving, air-permeable collecting surface, which is subjected to suction and by which the fibers which fly away from each carding drum in a partial stream are successively received at locations which succeed each other in the direction of movement of the collecting surface.

Conventional carding apparatus comprises one carding drum and a plurality of working rollers for combing part of the fibers out of the fibrous material which is carried by the carding drum. Those fibers which have been entrained by the working rollers are removed from the latter and returned to the carding drums by clearing rollers. Whereas the working and clearing rollers open the fibrous material, the formation of a highly uniform fibrous web on the collecting surface was not ensured, particularly if the throughput of material was rather high. This was due to the fact that the fibers tend to ball together as they fly toward the collecting surface and this tendency increases with the number of fibers per unit of volume.

In order to avoid that disadvantage and to permit the making of a uniform fibrous web, it is already known from Austrian Pat. No. 325,996 to provide above the carding drum a second carding drum, which is fed with part of the fibers of the fibrous feed web. That part has been removed from the first carding drum by means of a working roller and a clearing roller. As a result, two partial streams of the fibers are received by the collecting surface at locations which succeed each other in the direction of movement of the collecting surface. As a result, the fiber density in each partial stream is reduced so that the fibers are more uniformly deposited on the collecting surface. Besides, the fibrous web is built up in two layers so that the doubling effect results in a higher uniformity even if there is an irregularity in one partial stream. Such irregularities in the resulting fibrous web are compensated at least in part by the formation of the second layer. In order to achieve a higher throughput of material and a still further uniformity, it would be desirable to divide the fibrous feed web into more than two partial streams. But that is not possible with the known apparatus. Besides, the transfer of part of the fibrous material from one carding drum to another by means of a pair of working and clearer rollers is expensive and such arrangement is liable to be deranged.

SUMMARY OF THE INVENTION

It is an object of the invention so to improve an apparatus of the kind described first hereinbefore that a simple division of the fibrous feed web into partial streams to be successively received by the collecting surface is ensured with a low structural expenditure.

This object is accomplished in accordance with the invention by so closely spacing the carding drums apart in the direction of travel of the collecting surface that each carding drum which succeeds another in the direction of travel of the collecting surface constitutes a working roller for cooperation with the next preceding carding drum.

Because the carding drums are closely spaced apart without an interposition of working or clearer rollers, each succeeding carding drum can act like a working roller to comb out the fibrous material which is carried by the next preceding carding drum. Immediately after the combing operation, the fibers carried by the preceding carding drum are thrown off onto the collecting surface. Each succeeding carding drum can be used for an additional combing operation so that an excellent opening of the fibrous feed web into a plurality of partial streams is effected with simple means.

A control of the streams of fibers which are thrown off from each carding drum may be effected by suitably influencing the combing operation of the respective succeeding carding drum. This can be accomplished, e.g., with carding drums having different sets of teeth. Alternatively, the carding drums may be driven at different peripheral velocities. Compared with different sets of teeth, different peripheral velocities afford the advantage that the adaptation to different conditions is facilitated. Besides, the transfer of part of the fibrous material from one carding drum to the next may be controlled by the spacing of the carding drums.

The fibers thrown from the carding drums cannot be uniformly applied to the collecting surface if the flight of the fibers to the collecting surface is disturbed. For this purpose, the carding drums are desirably covered toward the collecting surface and discharge ducts are, disposed between the covers and extend in the generally triangular spaces between the carding drums. An air stream which is sucked through the collecting surface is passed through the discharge ducts and entrains the fibers which have been thrown from the carding drums so that said fibers are carried to the collecting surface.

In order to avoid air currents which might disturb the fibrous layer that has previously been built up, each space above the collecting surface and disposed between adjacent discharge ducts may be sealed from such discharge ducts by rollers pressing against the fibrous layer that has already been formed to ensure an adequate seal. The rollers do not obstruct the conveyance of the fibrous layer that has been built up and compress said layer so that the fibers cohere more strongly to each other and the resistance to a dislocation of individual fibers is increased.

To avoid a disturbance by currents having a component of movement which is parallel to the collecting surface, air currents in each space above the collecting surface and disposed between adjacent discharge ducts should be inhibited as far as possible. For this purpose the discharge ducts may carry sealing lips in contact with the rollers so that the spaces between the discharge ducts, the covers and the collecting surface are sealed from the outside. Since no suction is applied to the collecting surface adjacent to those spaces which are sealed from the discharge ducts, the fibrous layer which is conveyed through said spaces will not be subjected to a disturbing influence from the suction side.

The tendency to form knots will be increased whenever the fibers thrown from the carding drums reach an air cushion. For this reason, a formation of knots cannot be avoided unless the air current which is passed through a discharge duct and sucked through the collecting surface has a velocity of flow which matches the velocity at which the fibers are thrown off. Such air stream cannot be sucked through the collecting surface unless air is available at an adequate rate. If two blast nozzles are provided in each generally triangular space between adjacent carding drums on that side thereof which is remote from the collecting surface and said blast nozzles are directed toward the nip between the carding drums, this will ensure that air can flow through the nip between the carding drums at such a rate that said air can entrain the fibers thrown from the carding drums and can carry those fibers to the collecting surface at a velocity which matches the discharge velocity from that triangular space which is defined by the carding drums on the side facing the collecting surface. The air stream blown through the nip between the carding drums will also assist the separation of the fibers from the carding drums.

This fact can be utilized for a control of the partial streams of fibers by mounting the blast nozzles to be adjustable transversely to the longitudinal direction of the nip between adjacent carding drums. An adjustment of the blast nozzles toward one or the other of the two cooperating carding drums will change the action of the air on the carding drums so that the separating effects will be altered.

If the discharge ducts have such a flow area that, when the blast nozzles deliver air at a nominal rate, the air will flow in the associated discharge duct at least at a velocity which matches the surface velocity of the carding drum rotating toward the collecting surface on the side facing the discharge duct, the fibers which are thrown off will be supplied to the collecting surface in a uniform stream without a disturbing retention. If the resistances to flow are left out of consideration, the flow area which is required for a given average velocity of flow will depend on the ratio of the air supply rate to the required velocity of flow. For this reason, the desired velocity of flow in the discharge ducts can be provided in a simple manner if the blast nozzles deliver air at a predetermined nominal rate and the discharge duct has a properly selected, predetermined flow area.

If the flow area of each discharge duct decreases toward the collecting surface, the air stream will be accelerated as it approaches the collecting surface so that the uniform conveyance of the fibers toward the collecting surface will be assisted.

BRIEF DESCRIPTION OF THE DRAWING

The subject matter of the invention is shown by way of example on the drawing, which is a diagrammatic vertical sectional view showing apparatus in accordance with the invention for making a fibrous web.

DESCRIPTION OF PREFERRED EMBODIMENT

The illustrated apparatus comprises a material inlet for a fibrous feed web. That inlet comprises a feed roller 1 and a guide deck 2. The apparatus also comprises a plurality of closely spaced apart, juxtaposed carding drums 3, 4, 5, 6, which rotate in the same sense, and a revolving conveyor belt, constituting a collecting surface 7 which extends under, and is spaced from, the carding drums 3, 4, 5 and 6. That conveyor belt is permeable to air and is subjected to suction by a suction box 8. To assist the production of a suitable air stream delivering fibers from the carding drums through discharge ducts 10 to collecting surface 7, the carding drums 3, 4, 5, 6 are shielded from the collecting surface 7 by covers 9. Discharge ducts 10 are provided between adjacent covers. Each discharge duct 10 extends into the generally triangular space which is defined by adjacent ones of carding drums 3, 4, 5 and 6 on the side thereof which faces the collecting surface 7. The spaces 11 between the discharge ducts 10 are sealed from the collecting surface 7 by rollers 12 pressing against the previously formed fibrous layer. Covers 9 carry sealing lips 13, which engage the rollers 12 and complete the seal of the discharge ducts 10. Because inserts 14 in the suction box 8 ensure that the collecting surface 7 will not be subjected to suction in the areas between the discharge ducts 10, an air stream by which the fibers thrown from the carding drums are entrained and carried onto the collecting surface 7 will be obtained only along discharge ducts 10 and there will be no such air stream between the discharge ducts 10.

The velocity of the air in the discharge ducts 10 should match the velocity at which the fibers are thrown off and the air stream should entrain the fibers as they separate from the carding drums. These requirements can be met if two blast nozzles 15 are provided in the generally triangular space which is defined by two adjacent carding drums on that side thereof which is remote from the discharge ducts 10 and the collecting surface 7. Said blast nozzles 15 extend through a cover 16 provided on the outside of the carding drums and are directed toward the nip between the carding drums. The air delivered by said blast nozzles 15 flows through the nips between the carding drums into the discharge ducts 10 so that air is available at a rate which is adequate to ensure a required rate of flow of air through the collecting surface 7. The air flowing through the nip between the carding drums advantageously assists the separation of the fibers from the carding drums and entrains the separated fibers without a disturbance. The action of the air blown through the nips between the carding drums on the separation of the fibers from the carding drums will depend on the alignment of the blast nozzles with the nip between the carding drums and can be controlled by a dislocation of the blast nozzles in a direction which is transverse to the longitudinal direction of such nip. For this purpose the blast nozzles 15 are mounted for a limited pivotal movement about pivots 17, which are parallel to the nip and to the axes of the drums. In dependence on such adjustment, the nozzle tip can be directed into the nip between the carding drums or toward that carding drum which rotates toward or away from the collecting surface. Instead of being pivotally adjustable, as is indicated on the drawing, the blast nozzles 15 may be adjustable by a displacement in a direction which is transverse to the axes of the carding drums.

To ensure that the fibers which have been thrown off are not received by an air cushion, which would promote the formation of knots, the velocity of the entraining air stream flowing from the carding drums 3, 4, 5, 6 to the collecting surface 7 must match the velocity at which the fibers leave the carding drums. For this purpose, the flow areas of the discharge ducts 10 are restricted so that the air which is blown into the discharge ducts 10 and sucked through the collecting surface 7 will flow through the discharge duct 10 at a velocity that depends on the flow area of said duct. If the flow area of each discharge duct 10 is so selected that, during a delivery of air at a nominal rate from the blast nozzles 15, the velocity of the air in a given discharge duct will match the surface velocity of the associated carding drum which on the side facing said discharge duct rotates toward the collecting surface, the fibers which have been thrown off will be deposited on the collecting surface 7 without a disturbance. Flow areas involving a duct passage width not in excess of 50 millimeters will meet the requirements usually encountered in practice. Particularly advantageous conditions will be obtained if the discharge ducts 10 taper in flow area toward the connecting surface 7 because this will result in an acceleration of the air as it approaches the collecting surface so that a retention of fibers being supplied and a formation of knots will be precluded.

Because the carding drums 3, 4, 5, 6 are closely spaced apart, each succeeding carding drum constitutes a working roller for the next preceding carding drum. The fibrous feed web which is delivered by the feeder is entrained by the carding drum 3 and is delivered by the latter to the carding drum 4, which rotates in the same sense and combs out part of the fibrous material and carries said part to the next succeeding carding drum 5. The fibrous material which has not been entrained by the carding drum 4 is thrown off into the discharge duct 10 and by the air stream in the discharge duct is entrained and deposited onto the collecting surface 7.

The fibrous material which is carried further by the carding drum 4 is divided adjacent to the carding drum 5 into a partial stream of fibers to be thrown off and a partial stream of fibers to be carried further. The latter partial stream is divided once more adjacent to the further carding drum 6 by a further combing operation. It is apparent that the fibers of the fibrous feed web are uniformly deposited onto the collecting surface 7 in a plurality of partial streams at successive locations. Whereas the throughput of material is relatively high, the desity of fibers in each partial stream is low.

What is claimed is:

1. An apparatus for making a fibrous web, which comprises (a) a feeder for feeding fibers in the form of a fibrous web, (b) a plurality of successively arranged tooth-carrying carding drums rotatable about parallel axes in the same sense at a surface velocity sufficient to cause carded fibers to be thrown off each one of said drums by centrifugal force, a first one of said drums being arranged to receive the fibrous web from the feeder, (c) air-permeable means movable in a direction transverse to the drum axes and having a fiber-collecting surface facing the carding drums, (1) the carding drums being so closely spaced apart in said direction that each succeeding carding drum cooperates with a preceding one of the drums like a working roller, (d) discharge ducts in the spaces between the successive carding drums arranged to receive the fibers thrown off respective ones of the drums and to deliver respective streams of said fibers to the fiber-collecting surface at successive locations spaced in said direction whereby the fibers are collected as a fibrous web on the fiber-collecting surface, (e) means for supplying a stream of air into each one of the discharge ducts to move the streams of fibers to the fiber-collecting surface, and (f) suction means for sucking the air through the air-permeable means to retain the fibers of the fibrous web on the collecting surface.

2. The apparatus of claim 1, wherein at least two of said carding drums carry different sets of teeth.

3. The apparatus of claim 1, wherein said carding drums are rotatable at different surface velocities.

4. The apparatus of claim 1, wherein the spacing of the carding drums in said direction is adjustable.

5. The apparatus of claim 1, wherein adjacent ones of the successive carding drums define therebetween an air-permeable nip and a generally triangular space facing the fiber-collecting surface, the triangular space communicating with the nip and flaring towards the fiber-collecting surface, and each one of the dischage ducts extending through the nip and triangular space and having an end open to the fiber-collecting surface, and further comprising a cover between each one of the carding drums and the fiber-collecting surface.

6. The apparatus of claim 5, wherein each one of the covers defines a space with the fiber-collecting surface between successive ones of the discharge ducts, and further comprising two rollers in each one of said spaces at the open ends of the successive discharge ducts, the rollers being rotatable about respective axes extending parallel to the carding drum axes and arranged to press against the fibrous web on the fiber-collecting surface and to seal the open discharge duct ends from said space.

7. The apparatus of claim 6, wherein the covers carry sealing lips in sealing contact with said rollers.

8. The apparatus of claim 6, further comprising means preventing sucking of air through said air permeable means below said spaces between the covers and the fiber-collecting surface.

9. The apparatus of claim 1, wherein adjacent ones of the successive carding drums define therebetween an air-permeable nip and a generally triangular space facing away from the fiber-collecting surface, the triangular space communicating with the nip and flaring away from the fiber-collecting surface, and the means for supplying the stream of air comprises two blast nozzles associated with each one of the triangular spaces, the blast nozzles being disposed on the side of the nip remote from the fiber-collecting surface and being directed towards said nip.

10. The apparatus of claim 9, wherein the blast nozzles are mounted for adjustment transversely to the longitudinal direction of the associated nip.

11. The apparatus of claim 9, wherein adjacent ones of the successive carding drums define therebetween a generally triangular space facing the fiber-collecting surface, said triangular space communicating with the nip and flaring towards the fiber-collecting surface, and each one of the discharge ducts extending through the nip and triangular space and having an end open to the fiber-collecting surface, the blast nozzles being operable to deliver the air at a predetermined rate and each one of the discharge ducts having a flow area at the open end which causes the air to flow at a velocity at least equal to the surface velocity of the carding drums rotating towards the fiber-collecting surface, and further comprising a cover between each one of the carding drums and the fiber-collecting surface.

12. The apparatus of claim 11, wherein the flow area decreases towards the fiber-collecting surface.

* * * * *